US005533324A

United States Patent [19]

Furukawa et al.

[11] Patent Number: 5,533,324

[45] Date of Patent: Jul. 9, 1996

[54] METHOD FOR LOADING LIQUIDS INTO CONTAINERS MADE OF RESINS

[75] Inventors: Masahiko Furukawa; Toshio Masuda; Toru Kenmotsu, all of Kanagawa-ken, Japan

[73] Assignee: Fuji Photo Film Co., Ltd., Kanagawa, Japan

[21] Appl. No.: 126,656

[22] Filed: Sep. 27, 1993

[30] Foreign Application Priority Data

Oct. 12, 1992 [JP] Japan ..... 4-272945

[51] Int. Cl.[6] ..... B65B 1/04; B65B 3/04; B65B 35/56

[52] U.S. Cl. ..... 53/469; 53/474; 53/173; 53/446

[58] Field of Search ..... 53/289, 432, 434, 53/446, 471, 173, 469, 449, 474

[56] References Cited

U.S. PATENT DOCUMENTS

| | | | |
|---|---|---|---|
| 2,872,760 | 2/1959 | Meissner | 53/449 |
| 3,306,001 | 3/1967 | Peppler | 53/449 |
| 3,469,364 | 9/1969 | Bischoff | 53/469 |
| 4,308,710 | 1/1982 | Sandberg | 53/469 |
| 4,636,391 | 1/1987 | Pike | 53/434 |
| 5,014,499 | 5/1991 | Boeckmann | 53/551 |

*Primary Examiner*—John Sipos
*Assistant Examiner*—Rodney A. Butler
*Attorney, Agent, or Firm*—Sughrue, Mion, Zinn, Macpeak & Seas

[57] ABSTRACT

A method for loading a liquid into a container made of a resin comprises the steps of holding a portion of a bag, which is made of a resin film and which is provided with an opening, the portion surrounding the opening, and thereby suspending the bag in a case housing, which is to accommodate the bag therein. A predetermined amount of a liquid is poured through the opening into the bag, which is being suspended in the case housing, and thereafter the opening is closed. After the liquid has been poured into the bag, but before the opening is closed, the case housing is moved up, and the bag is thereby pushed up a predetermined distance, an appropriate amount of air being thus introduced into the bag having been loaded with the liquid. Worsening of the orientation or form of the bag and scratching or flawing of the bag are thus prevented from occurring due to vibrations given to the bag during its transportation, or the like.

7 Claims, 5 Drawing Sheets

METHOD FOR LOADING LIQUIDS INTO CONTAINERS MADE OF RESINS

BACKGROUND OF THE INVENTION

1. Field of the Invention

This invention relates to a method for loading a liquid into a container made of a resin. This invention particularly relates to a method for loading a liquid into a bag made of a resin film, which bag is accommodated in a case housing.

2. Description of the Prior Art

During processes for producing industrial chemicals, pharmaceutical preparations, foodstuffs, beverages, cosmetics, and the like, product liquids or intermediate product liquids are loaded into bags, which are made of resin films and which have comparatively large capacities. In general, operations for loading liquids into bags made of resin films are carried out in the manner described below. Specifically, a portion of a resin film bag surrounding its opening is held, and the bag is suspended in a predetermined case housing. In this state, a predetermined amount of a liquid is poured through the opening into the bag. Thereafter, the opening of the bag is closed. Even if the liquid has been loaded into the bag, the form of the bag is not fixed. Therefore, as described above, the bag is suspended in the case housing, and the bag having been loaded with the liquid is accommodated in the case housing such that the bag can be processed easily.

FIGS. 5A, 5B, and 5C are explanatory views showing the effects of a conventional method for loading a liquid into a container made of a resin.

As illustrated in FIG. 5A, a portion of a resin film bag 2 surrounding its opening 2*a* is held by a holding member 102, and the bag 2 is suspended in a case housing 4, such as a corrugated box. In this state, a predetermined amount of a liquid is poured through the opening 2*a* into the bag 2. Thereafter, as illustrated in FIG. 5B, the opening 2*a* is closed with a cap 6. As illustrated in FIG. 5C, the holding member 102 is then removed from the portion surrounding the opening 2*a*, and the bag 2 is allowed to fall into the case housing 4.

With the aforesaid conventional method for loading a liquid into a container made of a resin, the amount of air remaining in the bag 2 having been loaded with the liquid is determined by the form, which the bag 2 takes when it is being suspended. Therefore, the amount of air remaining in the bag 2 having been loaded with the liquid is comparatively small. As a result, as illustrated in FIG. 5C, the portion of the bag 2, which is in contact with air remaining in the bag 2, becomes slack. Each flap 4*a* of the case housing 4 is then folded inwardly along a marking-off line 4*b*, and the bag 2 is thereby accommodated in the case housing 4. In this state, the bag 2 is transported to a desired location. However, problems occur, in that, due to vibrations during transportation, and handling such that, the bag 2 easily moves in the case housing 4, and a gap occurs between the bag 2 and the case housing 4. As a result, the bag 2 becomes scratched. Also, the bag 2 shifts in the case housing 4, and the orientation or form of the bag 2 becomes incorrect so that the bag 2 cannot be easily taken out of the case housing 4. Further, if the amount of air remaining in the bag 2 having been loaded with the liquid is small, the problems will occur in that the bag 2 is swung or squeezed during its transportation, and folding streaks (flaws) occur with the bag 2. Therefore, there is the risk that the bag 2 cracks or breaks at the folding streaks, and the liquid leaks out from the bag 2.

SUMMARY OF THE INVENTION

The primary object of the present invention is to provide a method for loading a liquid into a container made of a resin, which is free of the problems of a conventional technique with regards to scratching of a container and takeout of the container.

Another object of the present invention is to provide a method for loading a liquid into a container made of a resin, which is free of the problems of a conventional technique with regards to cracking or breaking of a container and leak of a liquid out of the container.

The objects described above are accomplished with a method for loading a liquid into a container made of a resin in accordance with the present invention, wherein a case housing is moved up, and a bag (i.e. a container) made of a resin film is thereby pushed up a predetermined distance after a liquid has been poured into the bag, but before an opening of the bag is closed. By pushing the bag up a predetermined distance, air is introduced through the opening into the bag, and the amount of air remaining in the bag after being loaded with the liquid is adjusted to an appropriate amount.

Specifically, the present invention provides a method for loading a liquid into a container made of a resin comprising the steps of:

i) holding a portion of a bag, which is made of a resin film and which is provided with an opening, the portion surrounding the opening, ii) thereby suspending the bag in a case housing, which is to accommodate the bag therein, iii) pouring a predetermined amount of a liquid through the opening into the bag, which is being suspended in the case housing, and iv) thereafter closing the opening, wherein the case housing is moved up to thereby push up the bag a predetermined distance after the liquid has been poured into the bag, but before the opening is closed.

With the method for loading a liquid into a container made of a resin in accordance with the present invention, after the liquid has been poured into the bag made of a resin film, but before the opening of the bag is closed, the case housing is moved up and the bag is thereby pushed up a predetermined distance. Therefore, air can be introduced through the opening into the bag, and the amount of air remaining in the bag after being loaded with the liquid can be adjusted to an appropriate amount.

Accordingly, with the method for loading a liquid into a container made of a resin in accordance with the present invention, various problems encountered with the conventional method for loading a liquid into a container made of a resin can be eliminated. Specifically, the method for loading a liquid into a container made of a resin in accordance with the present invention can eliminate the problems in that the portion of the resin film bag, which is in contact with air remaining in the bag, becomes slack so that, due to vibrations during transportation, or handling, the bag easily moves in the case housing, and a gap occurs between the bag and the case housing. As described above, if such problems occur, the bag will become scratched. Also, the bag will shift in the case housing, and the orientation or form of the bag will become incorrect so that the bag cannot be easily taken out of the case housing. Further, the method for loading a liquid into a container made of a resin in accordance with the present invention can eliminate the problems in that, if the amount of air remaining in the bag having been loaded with the liquid is small, the bag will be swung or squeezed during its transportation, and folding streaks (flaws) will thereby occur with the bag. As described above, if such folding streaks occur, there will be the risk that the bag cracks or breaks at the folding streaks, and the liquid leaks out from the bag.

DESCRIPTION OF THE PREFERRED EMBODIMENTS

The present invention will hereinbelow be described in further detail with reference to the accompanying drawings.

Figure 1:
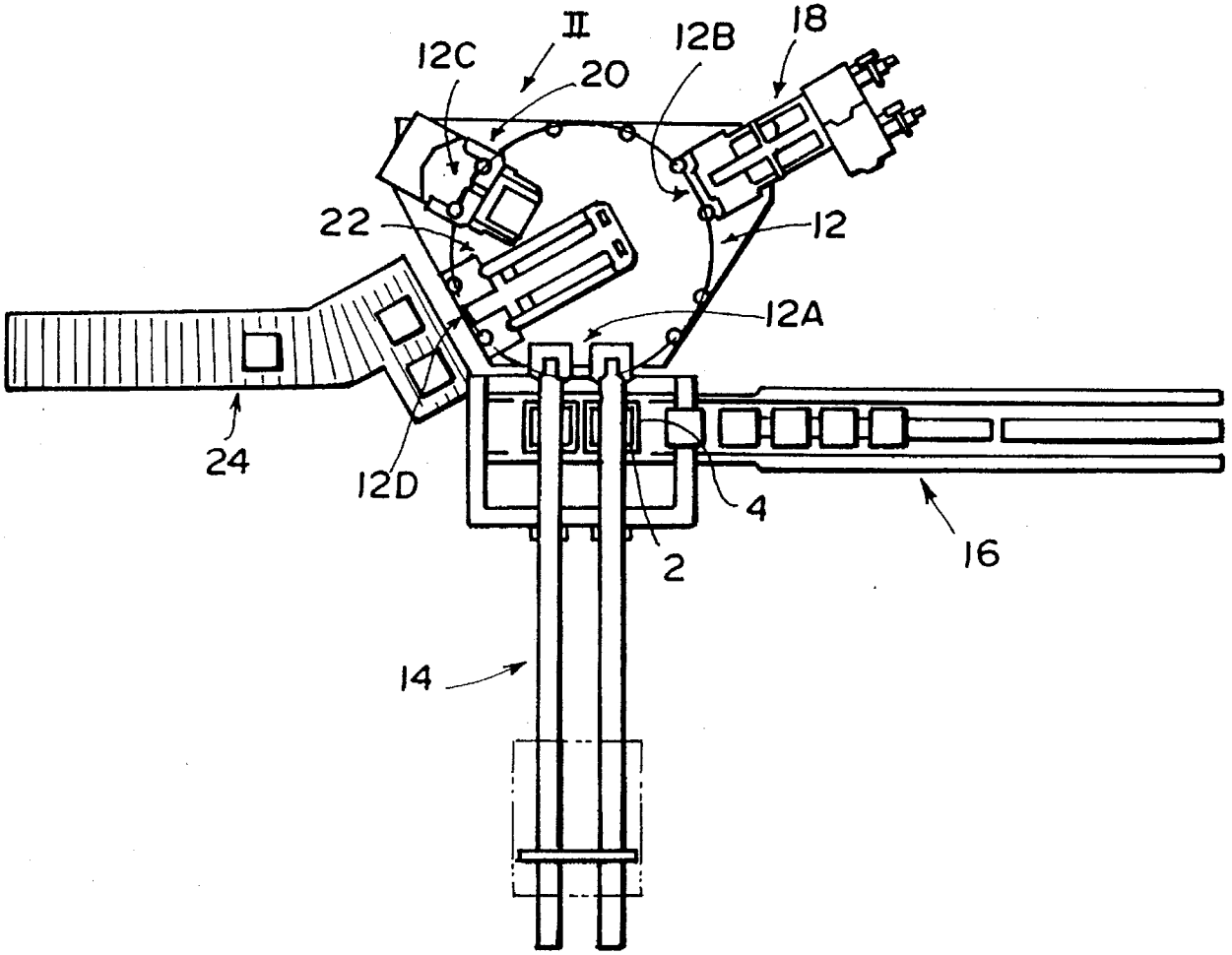
FIG. 1 is a plan view showing an embodiment of an apparatus for carrying out the method for loading a liquid into a container made of a resin in accordance with the present invention.
Figure 2:
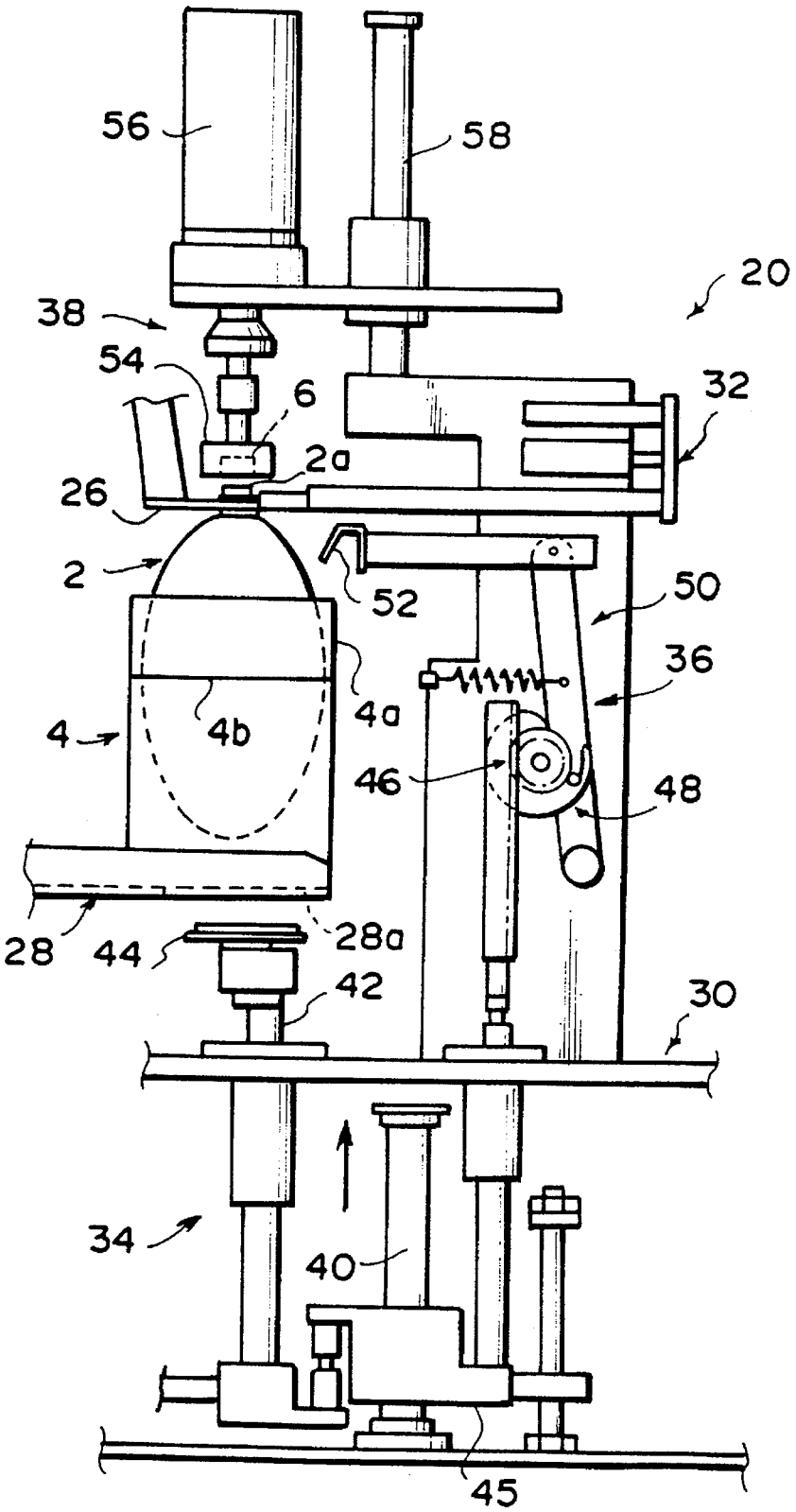
FIG. 2 is a side view showing the major part of the embodiment of FIG. 1, the view being taken from the direction indicated by the arrow II in FIG. 1.
Figure 3:
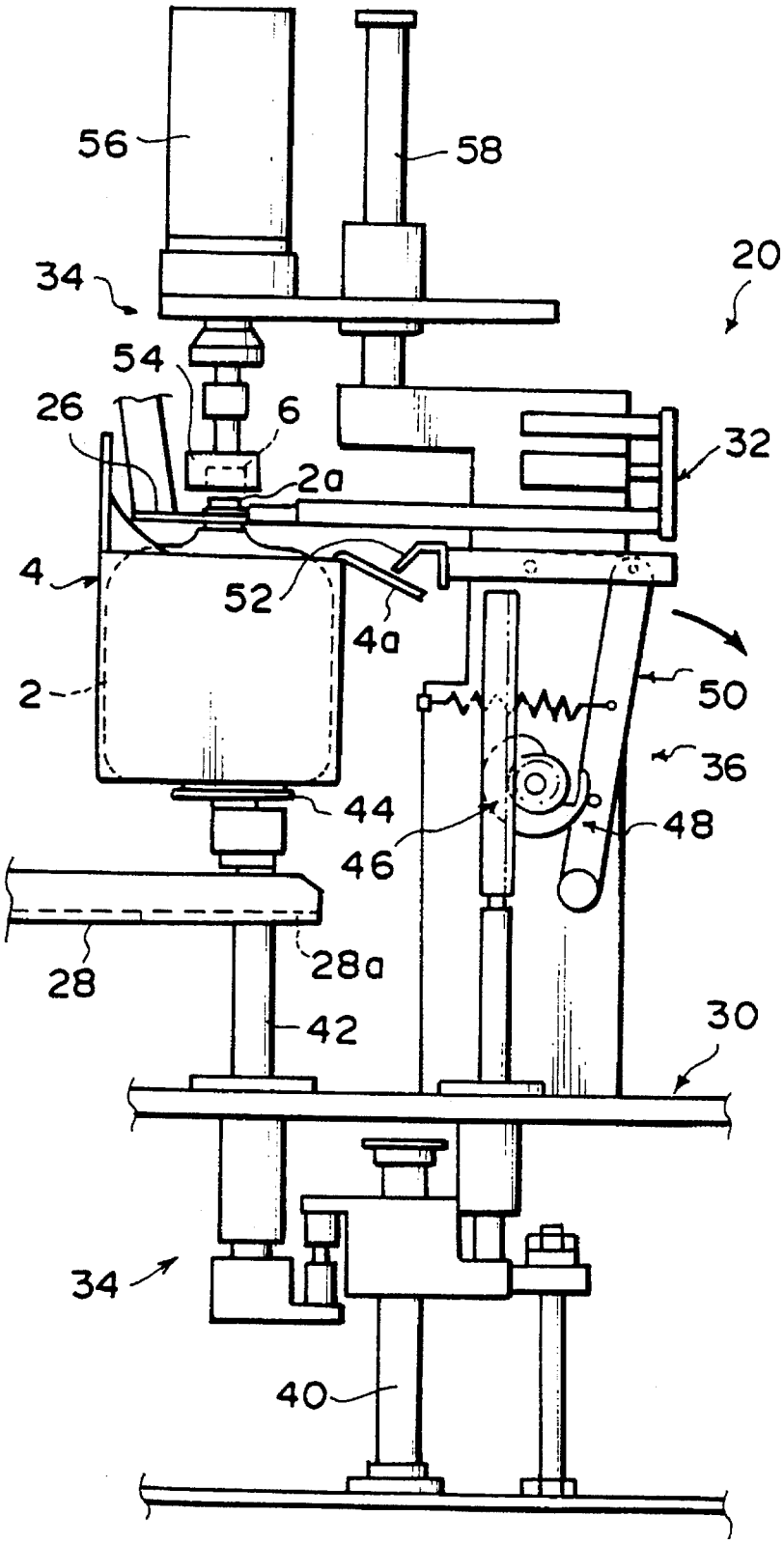
FIG. 3 is a side view equivalent to FIG. 2 and showing a step next to the step shown in FIG. 2, FIGS. 4A, 4B, and 4C are explanatory views showing the effects of the embodiment of FIG. 1, and FIGS. 5A, 5B, and 5C are explanatory views showing the effects of a conventional method for loading a liquid into a container made of a resin.

FIG. 1 is a plan view showing an embodiment of a liquid loading apparatus for carrying out the method for loading a liquid into a container made of a resin in accordance with the present invention. FIGS. 2 and 3 are side views showing the major part of the embodiment of FIG. 1, the views being taken from the direction indicated by the arrow II in FIG. 1.

As illustrated in FIG. 1, this embodiment of the liquid loading apparatus comprises an index table 12, a bag chute 14, a case housing conveyor 16, a liquid pouring device 18, a capping device 20, a push-out device 22, and feed-out rollers 24.

The index table 12 intermittently rotates at 60° increments along a circular conveyance path and stops at a feed-in station 12A, a liquid pouring station 12B, a capping station 12C, a feed-out station 12D, and two blank stations. The index table 12 is provided with a plurality of bag holding members 26, 26, . . . and a plurality of case housing receiving members 28, 28, . . . as illustrated in FIG. 2, which correspond to the respective stations.

The bag chute 14 supplies resin film bags (i.e. containers made of a resin) 2, 2, . . . to the feed-in station 12A of the index table 12. A portion of each bag 2 supplied to the feed-in station 12A, which portion surrounds an opening 2*a* of the bag 2, is held by the bag holding member 26.

The case housing conveyor 16 supplies case housings 4, 4, . . . , such as corrugated boxes, to the case housing receiving member 28, which is located below the bag holding member 26 at the feed-in station 12A of the index table 12. Each case housing 4 is supplied such that the bag 2 may be suspended in the case housing 4.

The liquid pouring device 18 is located at the liquid pouring station 12B of the index table 12 and pours a predetermined amount of a liquid into the bag 2, which has been stopped at the liquid pouring station 12B.

The capping device 20 is located at the capping station 12C of the index table 12. The capping device 20 closes the opening 2*a* of the bag 2, which has been loaded with the liquid and which has been stopped at the capping station 12C, as will be described later. Also, the capping device 20 releases the bag holding member 26, which holds the portion surrounding the opening 2*a* of the bag 2, from the bag 2 such that the bag 2 may be accommodated in the case housing 4.

The push-out device 22 is located at the feed-out station 12D of the index table 12 and pushes the case housing (i.e. the bag-containing case housing) 4, in which the bag 2 has been accommodated and which has been stopped at the feed-out station 12D, from the case housing receiving member 28 onto the feed-out rollers 24.

The feed-out rollers 24 convey the bag-containing case housing 4, which has been pushed out by the push-out device 22, to the exterior of the liquid loading apparatus.

As illustrated in FIG. 2, the capping device 20 is mounted on a frame 30 for the index table 12. The capping device 20 comprises a bag fixing device 32, a case housing lifter 34, a flap folding device 36, and a capper 38.

The bag fixing device 32 fixes the position of the opening 2*a* of the bag 2, which has been stopped at the capping station 12C, in cooperation with the bag holding member 26.

The case housing lifter 34 is provided with an air cylinder 40, a lifting rod 42 moved up and down by the air cylinder 40, and a case housing support plate 44 secured to an upper end of the lifting rod 42. When the position of the opening 2*a* of the bag 2 has been fixed by the bag fixing device 32, the air cylinder 40 is driven and moves up the lifting rod 42 until the case housing support plate 44 is brought to a predetermined height (i.e. to the position shown in FIG. 3). When the lifting rod 42 is thus moved up, the case housing support plate 44 passes through a cutaway portion 28*a* of the case housing receiving member 28, comes into contact with the bottom of the case housing 4, and pushes the case housing 4 up a predetermined distance. The case housing support plate 44 should preferably be a vacuum suction plate such that the position of the case housing 4 may be fixed by suction force at a predetermined position on the case housing support plate 44 and the case housing 4 may be prevented from shifting in position.

The flap folding device 36 is provided with a gear mechanism 46, a cam mechanism 48, a link mechanism 50, and a hook piece 52, which are interlocked with the case housing lifter 34. When the lifting rod 42 moves up and down, the hook piece 52 moves horizontally. Specifically, when the case housing 4 is pushed up by the case housing support plate 44, the hook piece 52 catches the flap 4*a* of the case housing 4 which is moving up. Also, the hook piece 52 is moved horizontally to the right in FIG. 2, and the flap 4*a* is thereby folded outwardly along the marking-off line 4*b*. In this manner, the flap 4*a* of the case housing 4 is prevented from interfering with the bag fixing device 32.

The capper 38 comprises a cap holder 54 for holding a cap 6, a motor 56 for rotating the cap holder 54, and a cylinder 58 for vertically moving the cap holder 54 and the motor 56. When the lifting rod 42 has been moved up until the case housing support plate 44 is brought to the predetermined height (i.e. to the position shown in FIG. 3), the cylinder 58 is driven in order to move the cap holder 54 down to the position of the opening 2*a* of the bag 2. Also, the motor 56 is operated in order to rotate the cap holder 54 such that the cap 6 may be engaged by threads with the portion of the bag 2 surrounding the opening 2*a*. In this manner, the opening 2*a* is closed.

The effects of this embodiment will be described hereinbelow with reference to FIGS. 4A, 4B, and 4C.

Figure 4A:
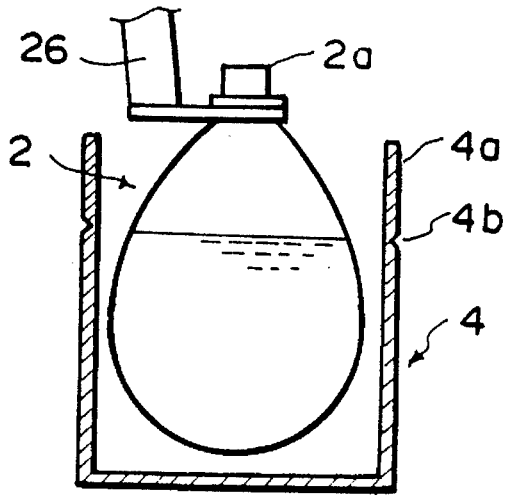
Figure 4B:
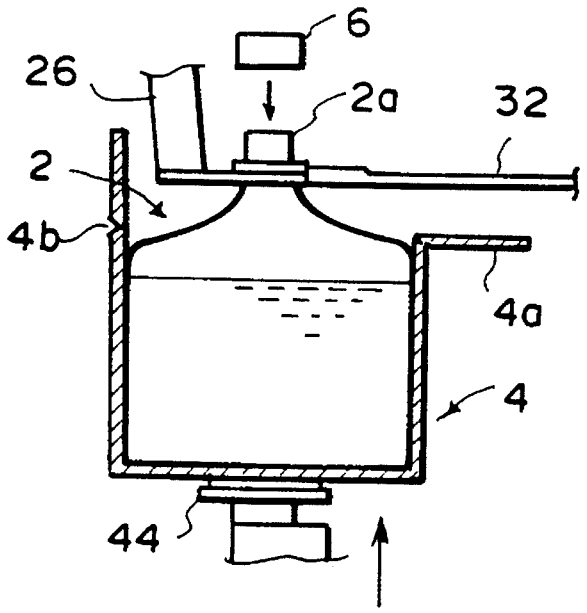
Figure 4C:
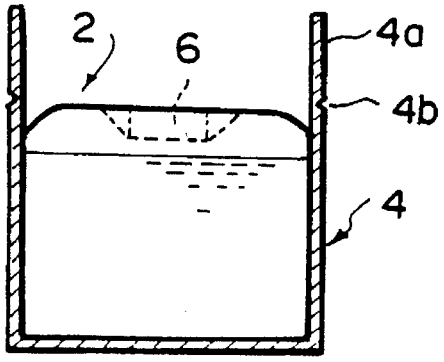
Figure 5A:
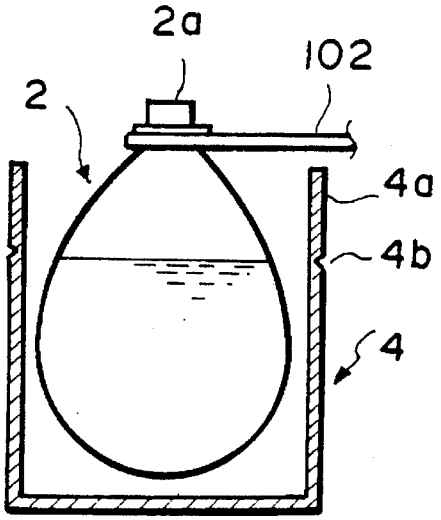
FIG.5A PRIOR ART
Figure 5B:
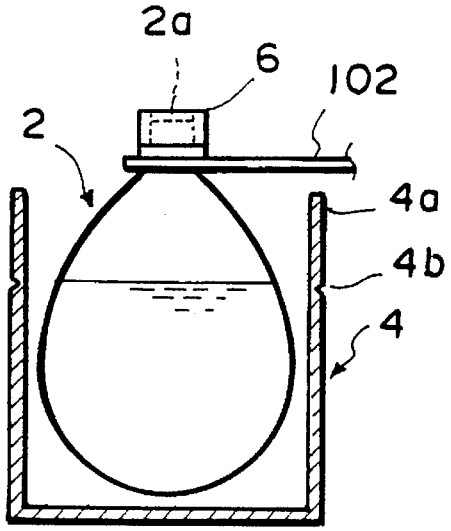
FIG.5B PRIOR ART
Figure 5C:
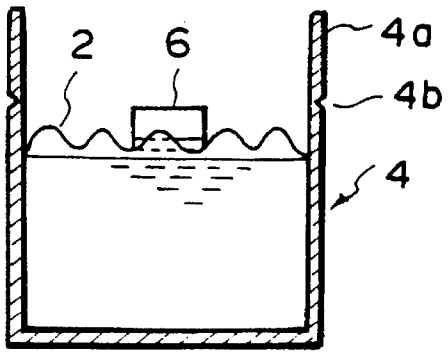
FIG.5C PRIOR ART

As illustrated in FIG. 4A, the portion of the bag 2 surrounding the opening 2*a* is held by the bag holding member 26, and the bag 2 is thereby suspended in the case housing 4. In this state, a predetermined amount of a liquid is poured through the opening 2*a* into the bag 2. Thereafter, as illustrated in FIG. 4B, the position of the opening 2*a* of the bag 2 is fixed by the bag fixing device 32, and the opening 2*a* is closed with the cap 6. Before the opening 2*a* is closed, the case housing 4 is moved up by the case housing support plate 44, and the bag 2 located in the case housing 4 is pushed up to the position shown in FIG. 4B. When the bag 2 is thus pushed up, air can be introduced through the opening 2*a* into the bag 2. Thereafter, the opening 2*a* is closed with the cap 6 as described above, and the portion of the bag 2 surrounding the opening 2*a* is released from the held state. At this time, as illustrated in FIG. 4C, because air has been introduced into the bag 2 in the manner described above, the amount of air remaining in the bag 2 having been loaded with the liquid can be kept at an appropriate amount. Accordingly, when each flap 4*a* is folded inwardly along the marking-off line 4*b*, the gap between the bag 2 and the case housing 4 is minimized. The adjustment of the amount of air remaining in the bag 2 may be carried out by adjusting the distance by which the bag 2 is pushed up.

As described above, with this embodiment, the portion of the bag 2, which is in contact with air remaining in the bag 2, can be prevented from becoming slack. Also, the gap between the bag 2 and the case housing 4 can be minimized. Therefore, the orientation or form of the bag 2 can be prevented from becoming incorrect due to vibrations given to the bag 2 during its transportation, or the like. Further, the bag 2 can be prevented from becoming scratched or flawed during its transportation.

Also, with this embodiment, when the case housing 4 is pushed up by the case housing support plate 44, the hook piece 52 catches the flap 4*a* of the case housing 4 which is moving up. The hook piece 52 is then moved horizontally to the right, as in FIG. 2, and the flap 4*a* is thereby folded outwardly along the marking-off line 4*b*. Therefore, the flap 4*a* of the case housing 4 can be prevented from interfering with the bag fixing device 32 and can thus be prevented from being deformed or broken.

Tests carried out to confirm the effects of this embodiment will be described hereinbelow.

(1) Test conditions

Four methods described below were used in order to load liquids into resin film bags. With each method, 1,000 bags loaded with the liquids and accommodated in case housings were prepared. The bags obtained with the four methods were transported by a single motor truck. After the transportation, scratches and flaws occurring with the bags and orientations or forms of the bags in the case housings were investigated visually.

1. Conventional method (1)

A photographic processing agent was loaded into resin film bags. With this method, the bags were capped while the bags having been loaded with the liquid were being suspended. The bags used were 5-liter, thin-walled polyethylene containers.

2. Method of the present invention (1)

A photographic processing agent was loaded into resin film bags. With this method, during the capping of the bags, the aforesaid embodiment of the apparatus for carrying out the method for loading a liquid into a container made of a resin in accordance with the present invention was used such that an appropriate amount of air might be introduced into the bags having been loaded with the liquid. The bags used were 5-liter, thin-walled polyethylene containers.

3. Conventional method (2)

A neutral detergent was loaded into resin film bags. With this method, the bags were capped while the bags having been loaded with the liquid were being suspended. The bags used were 10-liter, thin-walled polyethylene containers.

4. Method of the present invention (2)

A neutral detergent was loaded into resin film bags. With this method, during the capping of the bags, the aforesaid embodiment of the apparatus for carrying out the method for loading a liquid into a container made of a resin in accordance with the present invention was used such that an appropriate amount of air might be introduced into the bags having been loaded with the liquid. The bags used were 10-liter, thin-walled polyethylene containers.

(2) Test results

TABLE 1

| | Loading method | Liquid loaded | Amount loaded | Scratches or flaws of bag | Bag orientation or form in case housing |
|---|---|---|---|---|---|
| 1 | Conventional method (1) | Photographic processing agent | 5 liters | 18/1,000 bags | X |
| 2 | Method of the present invention (1) | Photographic processing agent | 5 liters | 0/1,000 bags | o |
| 3 | Conventional method (2) | Neutral detergent | 10 liters | 12/1,000 bags | Δ |
| 4 | Method of the present invention (2) | Neutral detergent | 10 liters | 0/1,000 bags | o |

As is clear from Table 1, scratches or flaws occurred with some of the bags, which were loaded with the liquids in accordance with the conventional methods. On the other hand, no scratch nor flaw occurred with the bags, which were loaded with the liquids by using the methods in accordance with the present invention. Also, the orientations or forms of the bags, which were loaded with the liquids in accordance with the conventional methods, in the case housings became incorrect (Δ) or markedly incorrect (×). On the other hand, the orientations or forms of the bags, which were loaded with the liquids by using the methods in accordance with the present invention, in the case housings did not so much changed from the original orientations or forms (o).

What is claimed is:

1. A method for loading liquid into containers made of a resin, comprising the steps of:

providing a plurality of case housings in succession;

providing a plurality of preformed resin film bags in succession, each of said preformed resin film bags having an opening and a bottom, said opening of each bag being independent of the bottom of the next succeeding bag before pouring said predetermined amount of liquid into said preformed bag;

holding a portion of a first bag from said plurality of bags, the portion surrounding the opening;

suspending said first bag in a first case housing configured to accommodate the bag therein;

pouring a predetermined amount of a liquid into said first bag suspended in said first case housing;

moving said first case housing upwardly against said first bag and beyond to attendantly push said first bag up a predetermined distance after completion of pouring the predetermined amount of liquid into said first bag, while the opening remains open, such that an appropriate amount of air remains in said first bag;

closing the opening of said first bag, and repeating said method to fill subsequent preformed bags in subsequent containers.

2. A method for loading a liquid into a container made of a resin, comprising the steps of:

providing an individual preformed bag, holding a portion of said bag, made of a resin film and provided with an opening, the portion surrounding the opening, suspending the bag in a case housing configured to accommodate the bag therein, pouring a predetermined amount of a liquid through the opening into the bag suspended in the case housing, moving the case housing upwardly against the bag and beyond to attendantly push the bag up a predetermined distance after completion of pouring the predetermined amount of liquid into the bag, while the opening remains open, and closing the opening.

3. A method as defined in claim 1 wherein the predetermined distance, by which the bag is pushed up, is adjusted such that an appropriate amount of air may remain in the bag.

4. A method as defined in claim 1, further comprising the step of:

folding a flap of said case housing outwardly from said bag while moving up said case housing.

5. A method as defined in claim 2, further comprising the steps of:

providing a plurality of case housings in succession;

providing a plurality of preformed bags in succession, each of said preformed bags having an opening and a bottom, said opening of each bag being independent of the bottom of the next succeeding bag before pouring said predetermined amount of liquid into said preformed bag; and repeating said method to fill subsequent preformed bags in subsequent containers.

6. A method as defined in claim 2 wherein said moving step allows air to enter into said bag.

7. A method as defined in claim 3, wherein said appropriate amount of air is determined by the shape and size of said case housing.

* * * * *